US007349654B2

(12) United States Patent
Joo et al.

(10) Patent No.: US 7,349,654 B2
(45) Date of Patent: Mar. 25, 2008

(54) DEVELOPER CARTRIDGE FOR A WET-TYPE IMAGE FORMING APPARATUS

(75) Inventors: Hae-Ree Joo, Seoul (KR); Jung-Wook Kim, Yongin-si (KR); Ki-Won Seok, Suwon-si (KR); Kyung-Yol Yon, Seongnam-si (KR); Deuck-Woo Jang, Seongnam-si (KR); Min-Young Cheong, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 166 days.

(21) Appl. No.: 11/265,077

(22) Filed: Nov. 3, 2005

(65) Prior Publication Data

US 2006/0133852 A1 Jun. 22, 2006

(30) Foreign Application Priority Data

Dec. 21, 2004 (KR) ..... 10-2004-0109410

(51) Int. Cl.
*G03G 15/10* (2006.01)
*G03G 15/08* (2006.01)

(52) U.S. Cl. ..... 399/238; 399/120

(58) Field of Classification Search ..... 399/119, 399/120, 237, 238, 244
See application file for complete search history.

(56) References Cited

U.S. PATENT DOCUMENTS 4,476,472 A * 10/1984 Aiba et al. ..... 347/86
5,821,965 A * 10/1998 Oda et al. ..... 347/86
6,341,209 B1 * 1/2002 Kim et al. ..... 399/237

FOREIGN PATENT DOCUMENTS

| | | |
|---|---|---|
| JP | 01-297254 | 11/1989 |
| JP | 2000-075624 | 3/2000 |
| JP | 2001-356660 | 12/2001 |
| KR | 1020010004146 | 1/2001 |

* cited by examiner

*Primary Examiner*—Hoang Ngo
(74) *Attorney, Agent, or Firm*—Roylance, Abrams, Berdo & Goodman L.L.P.

(57) ABSTRACT

A developer cartridge for a wet-type image forming apparatus including a cartridge body in which developer is stored. The cartridge body has a supply hole formed thereon to supply the developer in the cartridge to the image forming apparatus. A filter is disposed in the cartridge body to improve the dispersion of the developer, and to filter sludge of the developer before the developer flows into the supply hole.

19 Claims, 3 Drawing Sheets

DEVELOPER CARTRIDGE FOR A WET-TYPE IMAGE FORMING APPARATUS

CROSS REFERENCE TO RELATED APPLICATION

This application claims the benefit under 35 U.S.C. § 119(a) of Korean Patent Application No. 2004-109410, filed on Dec. 21, 2004, in the Korean Intellectual Property Office, the entire contents of which are hereby incorporated by reference.

BACKGROUND OF THE INVENTION

1. Field of the Invention

The present invention relates to a developer cartridge for a wet-type image forming apparatus. More particularly, the present invention relates to a developer cartridge with a filter to prevent toner sludge from being supplied to an image forming apparatus.

2. Description of the Related Art

Image forming apparatuses are typically classified as either monochrome image forming apparatuses or color image forming apparatuses. A monochrome image forming apparatus forms a monochrome image using a single color developer, while a color image forming apparatus forms a color image using different color developers, typically, magenta, cyan, yellow and black.

As widely known to those skilled in the relevant art, an electrophotographic image forming apparatus forms an electrostatic latent image on an organic photoconductor (OPC), which is charged with a predetermined electric potential by a charging unit, by scanning the OPC with laser beams projected from a laser scanning unit. The electrostatic latent image is developed into a visible image with developer, and the visible image is transferred to paper. In a color image forming apparatus, electrostatic latent images formed on respective color OPCs are developed into visible color images with color developers, and the separate color images are transferred and superimposed onto an intermediate transferring medium such as an intermediate transfer belt (ITB). The superimposed color images are then transferred from the intermediate transferring medium to a paper. The color images are fused onto the paper through a fusing process, and the paper is discharged from the image forming apparatus.

FIG. 1 shows a conventional color image forming apparatus which performs two transferring steps using an intermediate transfer belt (ITB). Referring to FIG. 1, the color image forming apparatus comprises an ITB 10, a support roller 11, T1 rollers 12, 13, 14, 15 which are provided by n color, organic photoconductor (OPCS) 16, 17, 18, 19 which are also provided by color, a T2 roller 20, and a belt drive roller 21.

Black (K), cyan (C), magenta (M) and yellow (Y) developers are attracted to electrostatic latent images formed on the respective OPCs 16, 17, 18, 19 through developing processes. The T1 rollers 12, 13, 14, 15 correspond to the OPCs 16, 17, 18, 19 and the ITB 10 is located between the rollers 12, 13, 14, 15 and the OPCs 16, 17, 18, 19. Accordingly, the developers attracted to surfaces of the respective OPCs 16, 17, 18, 19 are transferred and overlaid onto a surface of the ITB 10 at a first transferring step of the T1 rollers 12, 13, 14, 15. Thus, a single complete color image is formed on the ITB 10 through the first transferring step. Next, the color image is transferred from the ITB 10 to a printing medium 23 at a second transferring step which is performed between the T2 roller 20 and the belt drive roller 21.

Developing units 26, 27, 28, 29 are provided by color to develop the images on the respective OPCs 16, 17, 18, 19 with color developers. The respective color developing units 26, 27, 28, 29 are supplied with developers from respective color developer cartridges 36, 37, 38, 39 through pumps P. Used developers, including a liquid carrier, which remain in the developing units 26, 27, 28, 29, are recovered to the developer cartridges 36, 37, 38, 39.

According to the above-described construction, the respective color developer cartridges 36, 37, 38, 39 are connected to the respective developing units 26, 27, 28, 29 when being mounted in a body of the image forming apparatus, and thereby supply the developers to the developing units 26, 27, 28, 29. The color developer cartridges 36, 37, 38, 39 are disposable so that each developer cartridge is replaced with a new one after the developer in the cartridge is consumed.

The developer contained in each developer cartridge 36, 37, 38, 39 is an ink which is a mixture of powder color toners and a liquid carrier in a predetermined ratio. With this type of developer, toner sludge or toner mass may remain in the developer cartridges 36, 37, 38, 39 when the image forming apparatus is used. If toner sludge or toner mass is supplied to the developing units 26, 27, 28, 29, the images do not develop normally and thus the image quality deteriorates.

This becomes more problematic if toner sludge or toner mass clogs a supply pipe for the developers. In this case, liquid toner cannot be supplied and thus printing is not performed.

Accordingly, there is a need for an improved apparatus for handling liquid toner in a wet type image forming apparatus.

SUMMARY OF THE INVENTION

An aspect of the present invention is to solve at least the above problems and/or disadvantages and to provide at least the advantages described below. Accordingly, an aspect of the present invention is to provide a developer cartridge for a wet type image forming apparatus that has an improved structure for dispersing liquid toner, thereby preventing the generation of toner sludge or toner mass and preventing toner sludge or toner mass from moving toward developing units.

In accordance with an exemplary embodiment of the invention, a developer cartridge for a wet-type image forming apparatus comprises a cartridge body in which developer is stored. The cartridge body has a supply hole formed thereon to supply developer. A filter is disposed in the cartridge body to improve the dispersion of the developer, and to filter any sludge before the developer flows into the supply hole.

The filter may comprise a first filter member disposed at an approximate center of an inside of the cartridge body to filter the developer flowing into the supply hole.

The filter further may comprise a second filter member disposed in the cartridge body adjacent to the supply hole to filter the developer before the developer is supplied to the supply hole.

The first and the second filter members each may comprise a frame fixed onto an inner wall of the cartridge body and a mesh supported on the frame.

The developer cartridge may further comprise an agitator rotatably disposed in the cartridge body to agitate the developer.

The filter may comprise a first filter member disposed in the area where the agitator rotates, and a second filter member disposed away from the area where the agitator rotates, and adjacent to the supply hole.

The cartridge body may be provided with a recover hole to recover used developer.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
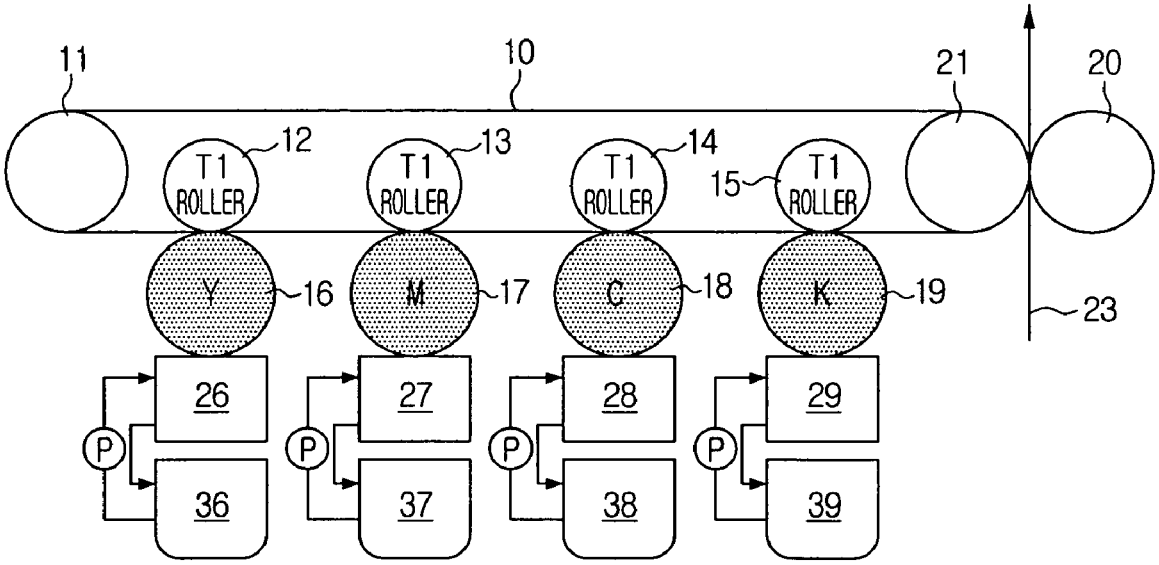
FIG. 1 (PRIOR ART)
FIG. 1 is a schematic view of a conventional color image forming apparatus.
Figure 2:
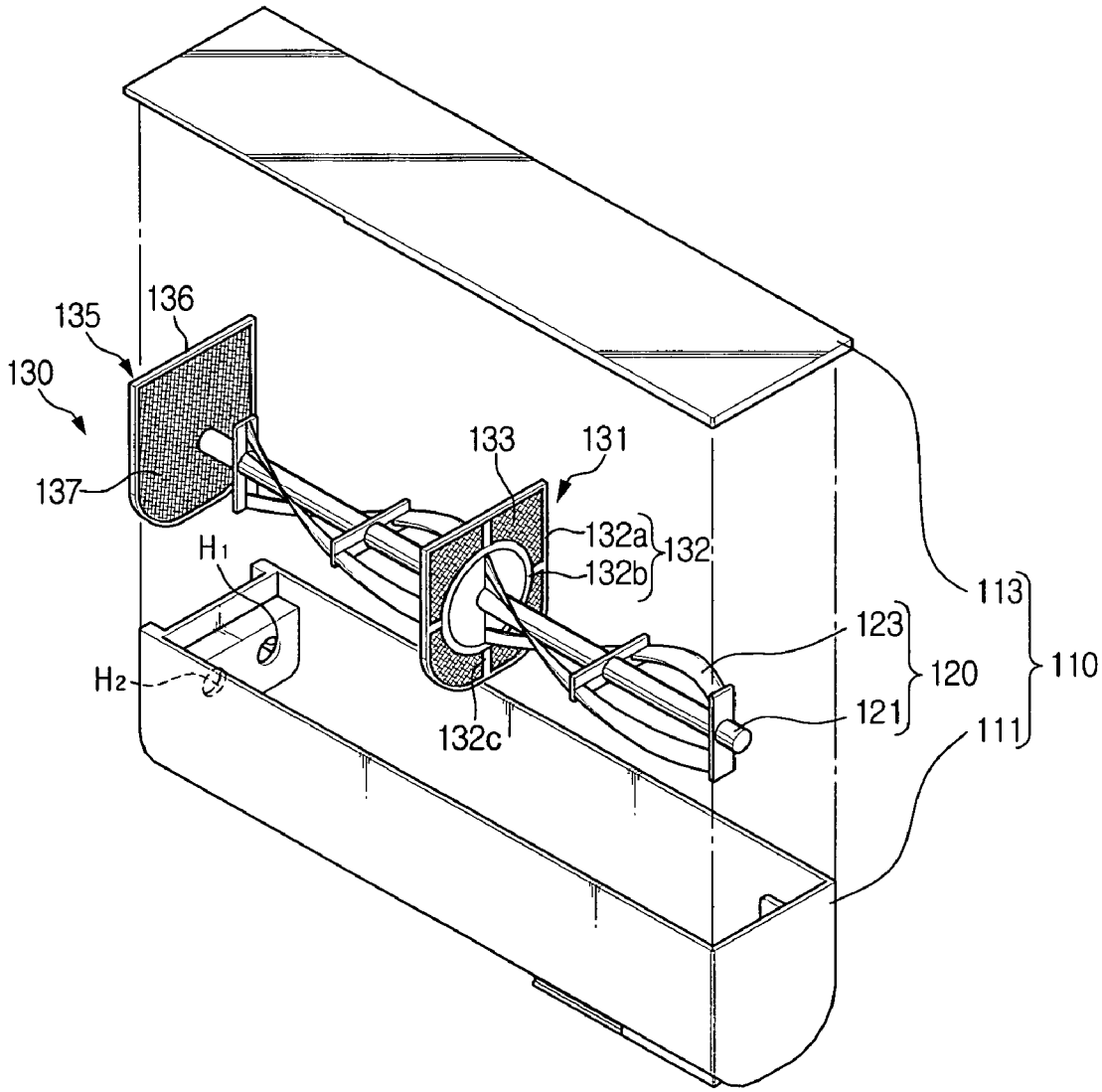
FIG. 2 is a schematic view of a developer cartridge for a wet-type image forming apparatus according to an exemplary embodiment of the present invention.
Figure 3:
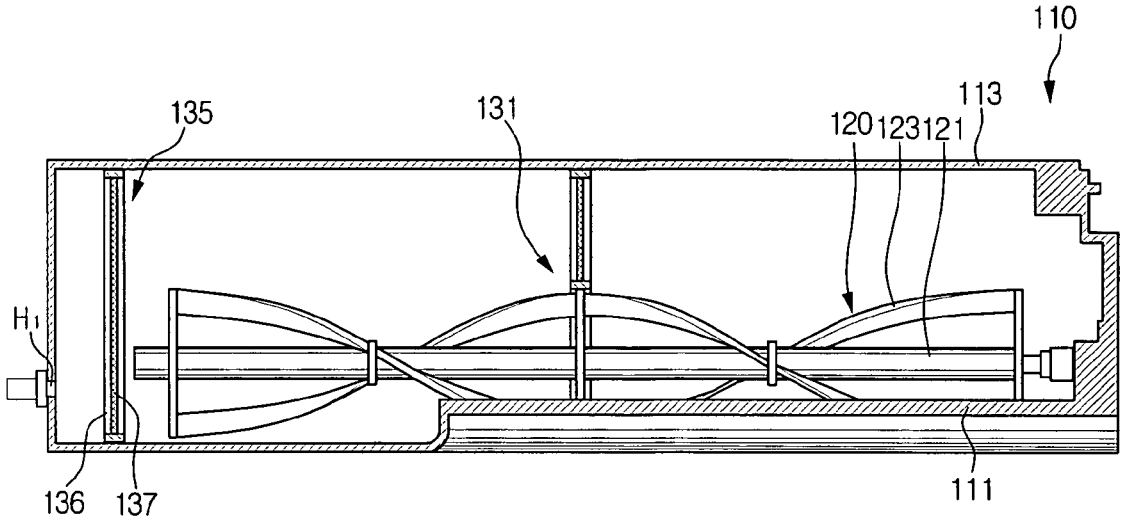
FIG. 3 is a cross-sectional view of the developer cartridge of FIG. 3.

Referring to FIGS. 2 and 3, a developer cartridge of a wet type image forming apparatus according to an exemplary embodiment of the present invention comprises a cartridge body 110, an agitator 120, and a filter 130.

The cartridge body 110 comprises a housing 111 in which developer is stored, and a cover 113 to cover an upper opening of the housing 111. The cover 113 seals the housing 111.

The developer stored in the developer 110 is an ink mixture that consists of powdery toner having a predetermined color, and a liquid carrier in a predetermined ratio.

The housing 111 has a supply hole H1 through which the developer is supplied to a developing unit, and a recover hole H2 through which used developer remaining in the developing unit is recovered to the housing 111. The supply hole H1 and the recover hole H2 are preferably formed in a side of the housing 111.

The agitator 120 is rotatably disposed in the cartridge body 110. The agitator 120 is connected with a driving part (not shown) and is rotated by a driving force. The agitator 120 is rotated to mix the powdery toner with the liquid carrier uniformly. The agitator 120 has a shaft 121 and a blade 123. The shaft 121 is rotatably connected with the housing 111. The blade 123 is disposed on an outer circumference of the shaft 121 in a spiral direction.

The filter 130 filters the developer before the developer is supplied to a developing unit through the supply hole H1. More specifically, toner sludge or toner mass may be generated in the cartridge body 110 if the developer is not used for a long time. The filter 130 prevents toner sludge or toner mass from being supplied to the supply hole H1. The filter 130 comprises a first filter member 131 and a second filter member 135 which are disposed apart from each other in the cartridge body 10.

The first filter member 131 is disposed in the cartridge body 110, preferably at an approximate center portion of the cartridge. Furthermore, the first filter member 131 is preferably located approximately in the center of the agitator 120, and is arranged generally orthogonally with respect to the shaft 121 of the agitator 120. The first filter member 131 preferably comprises a frame 132 and a mesh 133 supported on the frame 132. The frame 132 preferably comprises an outer frame 132*a* and an inner frame 132*b*. The outer frame 132*a* and the inner frame 132*b* may be connected with each other via at least one rib 132*c*. The outer frame 132*a* closely contacts an inner wall of the cartridge body 110. The inner frame 132*b* is rotatably connected with the agitator 120. The inner frame 132*b* has a hollow, ring shape so that it does not interfere with the rotational movement of the agitator 120. The inner frame 132*b* is rotatably connected with the center portion of the agitator 120.

The mesh 133 is connected with the frame 132. The mesh 133 has minute perforations having a size sufficient to pass toner particles therethrough. Accordingly, toner sludge or toner mass does not pass through the mesh 133, but collides with the mesh 133 and is broken up due to movement caused by the agitator 120.

The second filter member 135 is disposed adjacent to the supply hole H1. The second filter member 135 filters the developer before the developer is supplied to the developing unit through the supply hole H1. The second filter member 135 comprises a frame 136 and a mesh 137. The frame 136 maintains the shape of the second filter member 135 and closely contacts an inner wall of the cartridge body 110. The mesh 137 has minute perforations having a size sufficient to pass toner particles and a carrier therethrough but not to pass toner sludge or toner mass.

The first filter member 131 improves the dispersion of the liquid toner. The first filter member 131 breaks up and disperses toner sludge or toner mass generated in the liquid toner, thereby improving the dispersion of the liquid toner in the cartridge body 210.

The second filter member 135 filters the developer before the developer is supplied to the developing unit through the supply hole H1, thereby preventing toner sludge or toner mass, which has not yet been filtered by the first filter member 131, from flowing into the supply hole Hi. Accordingly, toner sludge or toner mass does not clog the supply hole H1, and thus, the developer can be smoothly supplied.

Also, since toner sludge or toner mass is prevented from being supplied to the developing unit, the developing unit can perform a developing operation more effectively.

Figure 4:
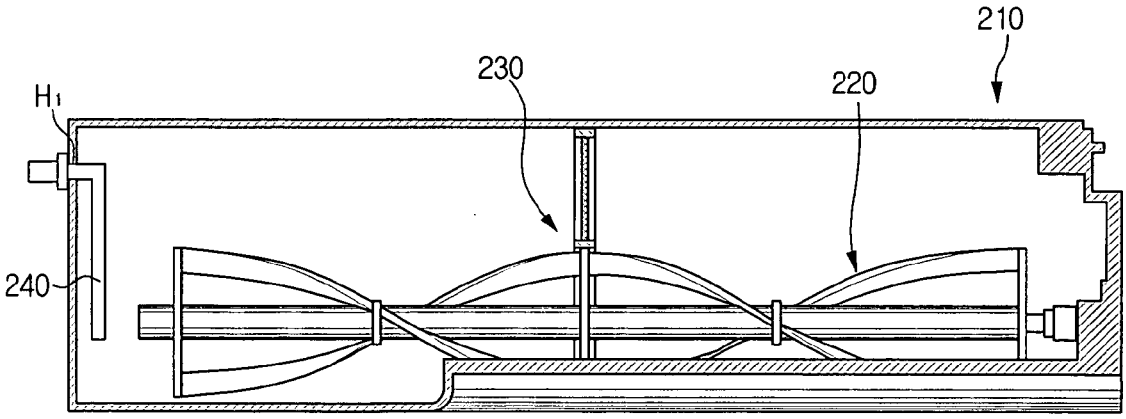
FIG. 4 is a cross-sectional view of a developer cartridge according to another exemplary embodiment of the present invention.

According to another embodiment of the present invention, a developer cartridge of a wet-type image forming apparatus has a single filter member 230 disposed in a cartridge body 210 as shown in FIG. 4. The filter member 230 is preferably disposed at an approximate center portion in view of the lengthwise direction of an agitator 220. The filter member 230 has the same structure as that of the first filter member 131 of the aforementioned embodiment.

The cartridge body 210 is provided with a supply hole H1 to supply developer therethrough. A supply tube 240 is connected to the supply hole H1 and extends toward the inside of the cartridge body 210 for a predetermined length. Any interference caused by the supply tube 240 and its required installation space are taken into consideration and thus, only one filter member 230 is provided. In this case, the filter member 230 can prevent toner sludge or toner mass, which is generated in at least one half of the cartridge, from being transferred to the developing apparatus.

As described above, according to the exemplary embodiments of a developer cartridge for a wet-type image forming apparatus, the efficiency of the agitator 120 or 220 increases due to the presence of the mesh 133 disposed in the developer cartridge. Thus, the generation of toner sludge or toner mass can be prevented. Accordingly, the dispersion of the liquid toner can be improved.

Also, since the mesh 137 disposed adjacent to the supply hole H1 can prevent foreign substances from being supplied to the developing unit, a developer supplying path can be prevented from being clogged. Accordingly, image quality can be improved.

While the invention has been shown and described with reference to certain embodiments thereof, it will be understood by those skilled in the art that various changes in form and details may be made therein without departing from the spirit and scope of the invention as defined by the appended claims.

What is claimed is:

1. A developer cartridge for a wet-type image forming apparatus comprising:

a cartridge body in which developer is stored, the cartridge body having a supply hole formed thereon to supply the developer to a developing unit; and a filter disposed in the cartridge body to improve the dispersion of the developer and to filter sludge of the developer before the developer flows into the supply hole;

wherein the filter comprises a first filter member disposed at an approximate longitudinal center of an inside of the cartridge body to filter the developer flowing into the supply hole.

2. A developer cartridge for a wet-type image forming apparatus comprising:

a cartridge body in which developer is stored, the cartridge body having a supply hole formed thereon to supply the developer to a developing unit; and a filter disposed in the cartridge body to improve the dispersion of the developer and to filter sludge of the developer before the developer flows into the supply hole;

wherein the filter comprises:

a first filter member disposed at an approximate center of an inside of the cartridge body to filter the developer flowing into the supply hole; and a second filter member disposed in the cartridge body adjacent to the supply hole to filter the developer before the developer is supplied to the supply hole.

3. The developer cartridge as claimed in claim 2, wherein the first and the second filter members each comprise:

a frame that contacts an inner wall of the cartridge body; and a mesh supported on the frame.

4. The developer cartridge as claimed in claim 1, further comprising:

an agitator rotatably disposed in the cartridge body to agitate the developer.

5. A developer cartridge for a wet-type image forming apparatus comprising:

a cartridge body in which developer is stored, the cartridge body having a supply hole formed thereon to supply the developer to a developing unit;

a filter disposed in the cartridge body to improve the dispersion of the developer and to filter sludge of the developer before the developer flows into the supply hole; and an agitator rotatably disposed in the cartridge body to agitate the developer;

wherein the filter comprises:

a first filter member disposed within the area where the agitator rotates; and a second filter member disposed away from the area where the agitator rotates and adjacent to the supply hole.

6. The developer cartridge as claimed in claim 1, wherein the cartridge body is provided with a recover hole to recover used developer therethrough.

7. A developer cartridge for a wet-type image forming apparatus comprising:

a cartridge body with a housing to store liquid developer, the cartridge body having a supply hole in the housing to supply the developer to the image forming apparatus;

an agitator rotatably disposed in the cartridge body to agitate the developer; and a first filter member disposed in the cartridge body and surrounding the agitator.

8. A developer cartridge according to claim 7, wherein the first filter member comprises:

an outer frame that contacts an inner wall of the housing of the cartridge;

an inner frame rotatably disposed around a central portion of the agitator; and a mesh disposed between the outer frame and inner frame.

9. A developer cartridge according to claim 8, further comprising:

at least one rib to connect the outer frame to the inner frame.

10. A developer cartridge according to claim 8, further comprising:

a supply tube connected to the supply hole.

11. A developer cartridge according to claim 8, wherein the mesh has minute perforations having a size sufficient to pass toner particles and a carrier therethrough but not to pass toner sludge or toner mass.

12. A developer cartridge according to claim 7, further comprising:

a second filter member disposed in the cartridge body adjacent to the supply hole.

13. A developer cartridge according to claim 7, further comprising:

a recover hole located in the housing of the developer cartridge.

14. A developer cartridge for a wet-type image forming apparatus comprising:

a cartridge body with a housing that stores liquid developer, the housing having a supply hole to supply the developer to the image forming apparatus;

an agitator rotatably disposed in the cartridge body;

a first filter member having an outer frame that contacts an inner wall of the housing of the cartridge, an inner frame rotatably disposed around a central portion of the agitator, and a mesh disposed between the outer frame and inner frame.

15. The developer cartridge as claimed in claim 14, further comprising:

a supply tube connected to the supply hole.

16. The developer cartridge according to claim 14, further comprising:

a recover hole located in the housing of the developer cartridge.

17. The developer cartridge as claimed in claim 14, further comprising:

a second filter member disposed in the cartridge body adjacent to the supply hole.

18. The developer cartridge as claimed in claim 17, wherein the second filter member has a mesh with minute perforations having a size sufficient to pass toner particles and a carrier but not to pass toner sludge or toner mass.

19. The developer cartridge as claimed in claim 18, wherein the mesh of the first filter member has minute perforations having a size sufficient to pass toner particles and a carrier but not to pass toner sludge or toner mass.

* * * * *